US008702027B2

(12) United States Patent
Akpan

(10) Patent No.: US 8,702,027 B2
(45) **Date of Patent: *Apr. 22, 2014**

(54) ADJUSTABLE BED MAT ROLLER

(71) Applicant: Kufre Effiong Akpan, Maple Grove, MN (US)

(72) Inventor: Kufre Effiong Akpan, Maple Grove, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/893,447

(22) Filed: May 14, 2013

(65) Prior Publication Data

US 2013/0240659 A1 Sep. 19, 2013

Related U.S. Application Data

(63) Continuation of application No. 12/657,756, filed on Jan. 27, 2010, now Pat. No. 8,444,079.

(51) Int. Cl.
*B65H 18/22* (2006.01)

(52) U.S. Cl.
USPC ..... 242/535.1; 242/535.4; 242/541.2; 242/541.3

(58) Field of Classification Search
USPC ..... 242/535.1, 535.4, 541.2–541.3
See application file for complete search history.

(56) References Cited

U.S. PATENT DOCUMENTS

| | | | | |
|---|---|---|---|---|
| 1,951,060 | A | 3/1934 | Mudd | |
| 2,573,188 | A | 10/1951 | Dyken | |
| 3,474,980 | A | 10/1969 | Mann, Jr. | |
| 3,782,664 | A | 1/1974 | Alberto | |
| 4,256,269 | A | 3/1981 | Feighery et al. | |
| 4,273,300 | A | 6/1981 | Wojtowicz et al. | |
| 4,298,173 | A | 11/1981 | Johansson | |
| 4,420,124 | A | 12/1983 | Bardsley et al. | |
| 4,542,859 | A | 9/1985 | Gerstenberger | |
| 4,573,644 | A | 3/1986 | Brown | |
| 4,765,554 | A | 8/1988 | Tuffal et al. | |
| 4,809,921 | A | 3/1989 | Dueck et al. | |
| 4,973,010 | A | 11/1990 | Brown | |
| 6,027,066 | A | 2/2000 | Street et al. | |
| 6,629,662 | B2 | 10/2003 | Howden et al. | |
| 8,444,079 | B2 * | 5/2013 | Akpan | 242/535.1 |
| 2002/0195516 | A1 | 12/2002 | Howden et al. | |

FOREIGN PATENT DOCUMENTS

| | | |
|---|---|---|
| GB | 2214496 B | 11/1991 |

* cited by examiner

*Primary Examiner* — Sang Kim
(74) *Attorney, Agent, or Firm* — Seager, Tufte & Wickhem LLC

(57) ABSTRACT

An bed roller machine for use in rolling a rug having a leading edge, comprising a main body having a main bed, a plurality of belts configured to move the leading edge of the rug into the cavity and up, a first set of fingers, each finger of the first set having a surface having a first concave cylindrical curvature, wherein the surfaces of the first set are aligned, and wherein the first set of fingers are movable as a set, and a second set of fingers, each finger of the second set having a surface having a second concave cylindrical curvature looser that that of the first surface, wherein the surfaces of the second set are aligned, and wherein the second set of fingers are movable as a set.

16 Claims, 6 Drawing Sheets

ADJUSTABLE BED MAT ROLLER

RELATED APPLICATIONS

This application is a continuation of U.S. application Ser. No. 12/657,756, filed Jan. 27, 2010, now U.S. Pat. No. 8,444,079.

FIELD

The present disclosure relates generally to machinery and methods for rolling large mats, carpets, rugs and the like.

BACKGROUND

Bed roller machines are typically used in the field of commercial rug cleaning Large rugs of the sort typically found in the lobbies, foyers and hallways of commercial, retail and industrial enterprises are sometimes removed for cleaning off-site. Once cleaned, these rugs are rolled on a bed roller machine to quickly shape the rug into a cylinder for ease of delivery.

A typical prior art bed roller machine is shown in FIG. 4. This machine has a first set of horizontal belts 1 interleaved with a second set of vertical belts 2. The first set of belts 1 moves the rug towards the second set of belts 2, which then moves the rug upward. An elbow 3 guides the front edge of the rug upwards towards a set of fingers 4, which fingers curve the front edge of the rug back over to begin forming the rug into the cylinder. Once the initial cylinder shape is formed, the action of the belts 1 and 2 continue to roll the rug into a cylindrical shape. The control panel is centrally located, below the first set of belts 1, and there are emergency stop buttons located on the hood above the fingers. This machine can roll a rug such that the hollow interior of the roll is about 5 inches in diameter.

A typical prior art bed roller machine is shown in FIG. 4. This machine has a first set of horizontal belts 1 interleaved with a second set of vertical belts 2. The first set of belts 1 moves the rug towards the second set of belts 2, which then moves the rug upward. An elbow 3 guides the front edge of the rug upwards towards a set of fingers 4, which fingers curve the front edge of the rug back over to begin forming the rug into the cylinder. Once the initial cylinder shape is formed, the action of the belts 1 and 2 continue to roll the rug into a cylindrical shape. A central elbow guides The control panel is centrally located, below the first set of belts 1, and there are emergency stop buttons located on the hood above the fingers. This machine can roll a rug such that the hollow interior of the roll is about 5 inches in diameter.

There is an ongoing need for a new and improved bed roller machine to roll rugs in an easier, safer manner and which produce rugs that are more tightly rolled.

SUMMARY

An adjustable bed roller machine according to a first embodiment of the invention may include a main belt that feeds the rug towards a first and second set of interleaved belts, which are placed away from the operator under a safety hood. The adjustable bed roller includes a first set of fingers and a second set of fingers. The first set of fingers have a tighter curve and are initially deployed when a rug is first fed into the machine to form a tight initial cylinder. After a time, the first set of fingers rotate up and a second set of fingers, which have a looser curve, rotate down to guide the rug as the rolled cylinder grows larger. An elbow may then be used to kick the rolled rug out of the machine. This machine can roll a rug so that the hollow interior of the rug is about 2 inches in diameter.

The adjustable bed roller may also include an adjustment mechanism to raise and lower the height of the main body of the machine. The main body of the machine may be mounted on the frame by a pivot toward the rear of the machine and by an air cylinder or other suitable mechanism near the front. The air cylinder may be adjusted to raise or lower the front of main body relative to the rear. A light curtain at the front of the hood to detect an intrusion into the space under the hood and shut the machine down in response thereto may also be included. The control box may be mounted to one side of the machine where it is not covered by a rug during the operation of the machine.

BRIEF DESCRIPTION OF DRAWINGS

The invention may be more completely understood in consideration of the following detailed description of various embodiments of the invention in connection with the accompanying drawings, in which.

DETAILED DESCRIPTION

Figure 1:
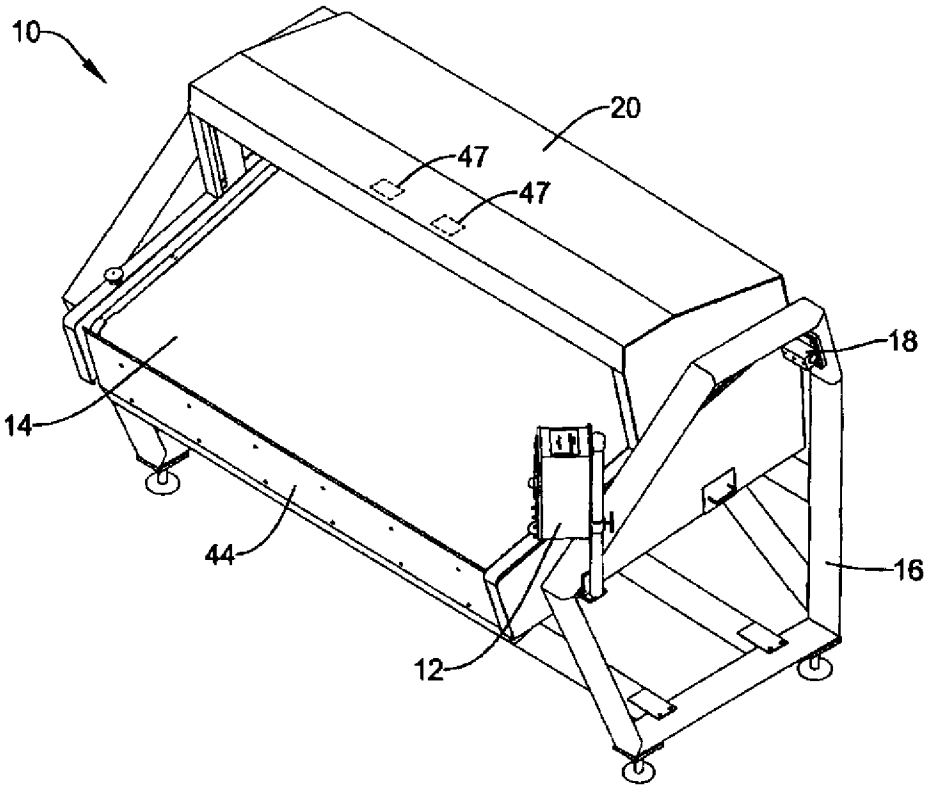
FIG. 1 is an isometric drawing of an adjustable bed roller machine 10.

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following description should be read with reference to the drawings wherein like reference numerals indicate like elements throughout the several views. The drawings, which are not necessarily to scale, depict illustrative embodiments of the claimed invention.

Figure 2:
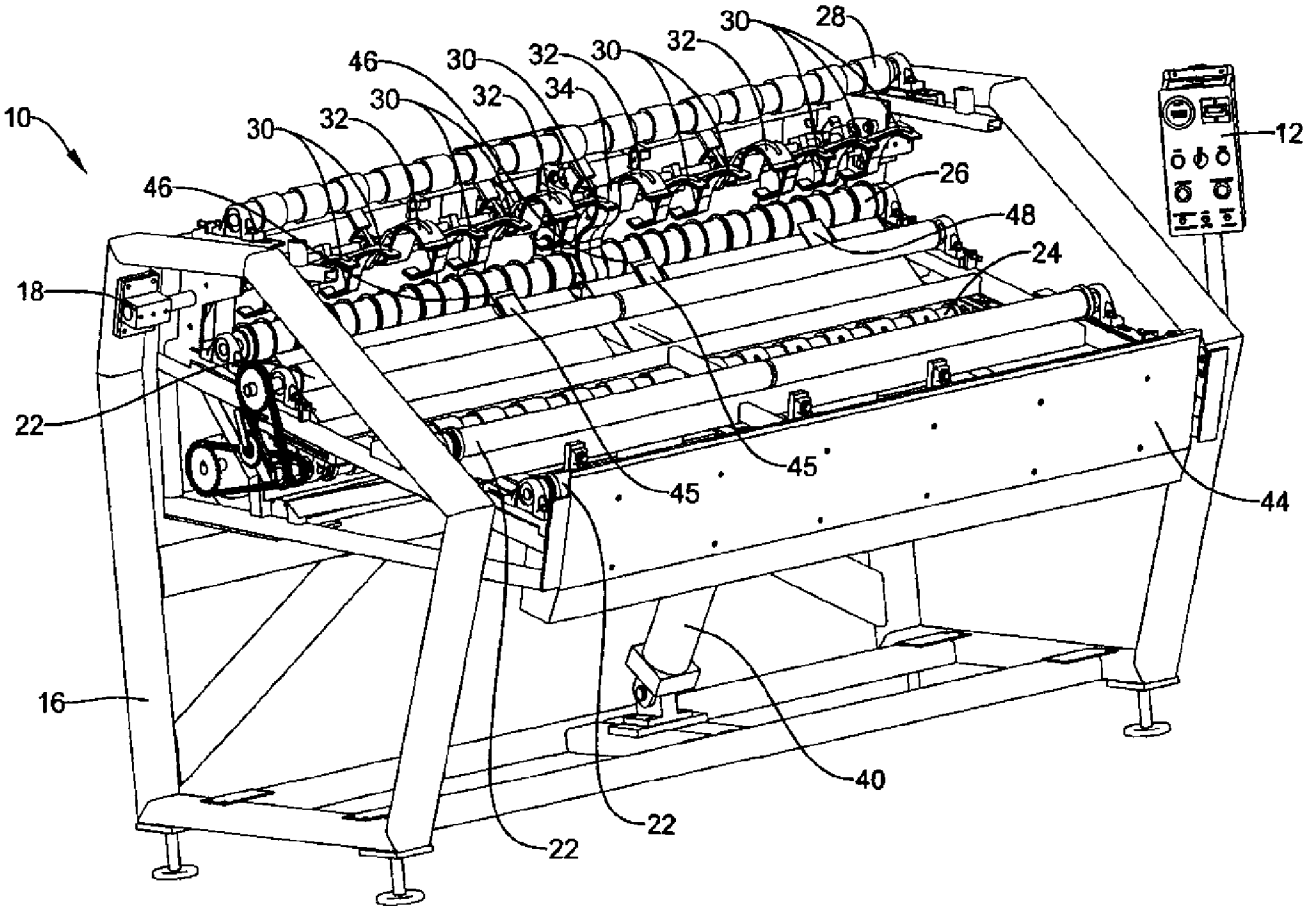
FIG. 2 is an isometric drawing of the adjustable bed roller machine 10 with certain components removed.
Figure 3:
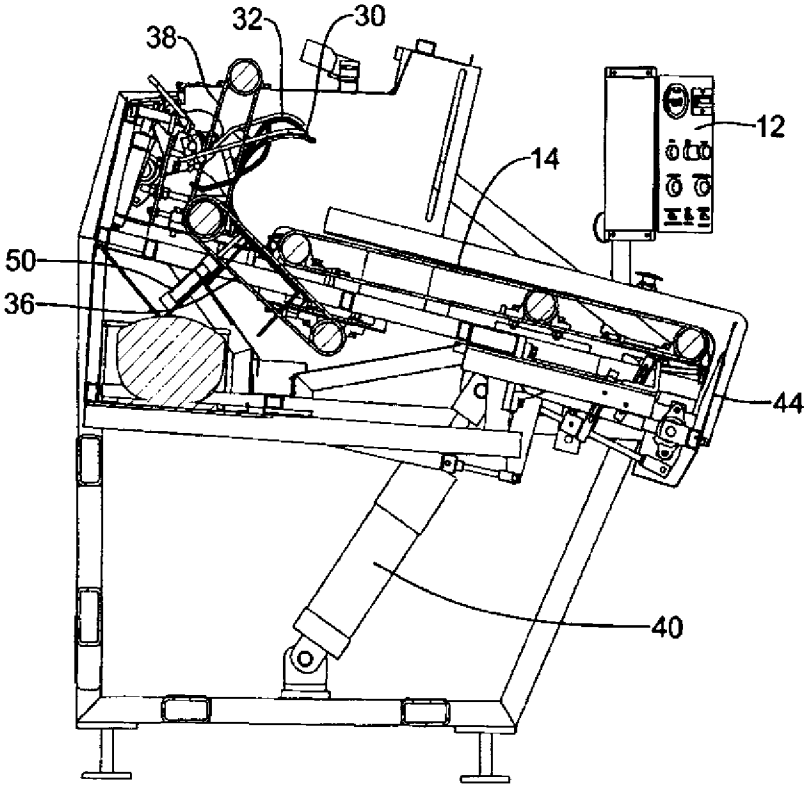
FIG. 3 is a side cross-sectional view of the adjustable bed roller machine 10.

An embodiment of an adjustable bed roller machine 10 will be described with reference to FIGS. 1-3 and 5-6. FIG. 1 is an isometric view showing certain of the externally visible components of adjustable bed roller machine 10. These include control panel 12, main belt 14, frame 16, pivot hinge 18 and hood 20. In FIGS. 2 and 3, one can also see a height adjustment cylinder 40. The main body of the adjustable bed roller machine 10 is connected to the frame 16 through pivot hinge 18 and height adjustment cylinder 40. One can operate the cylinder 40 through control panel 12 to raise or lower the front edge of the adjustable bed roller machine 10 to customize its height for a particular operator.

Figure 4:
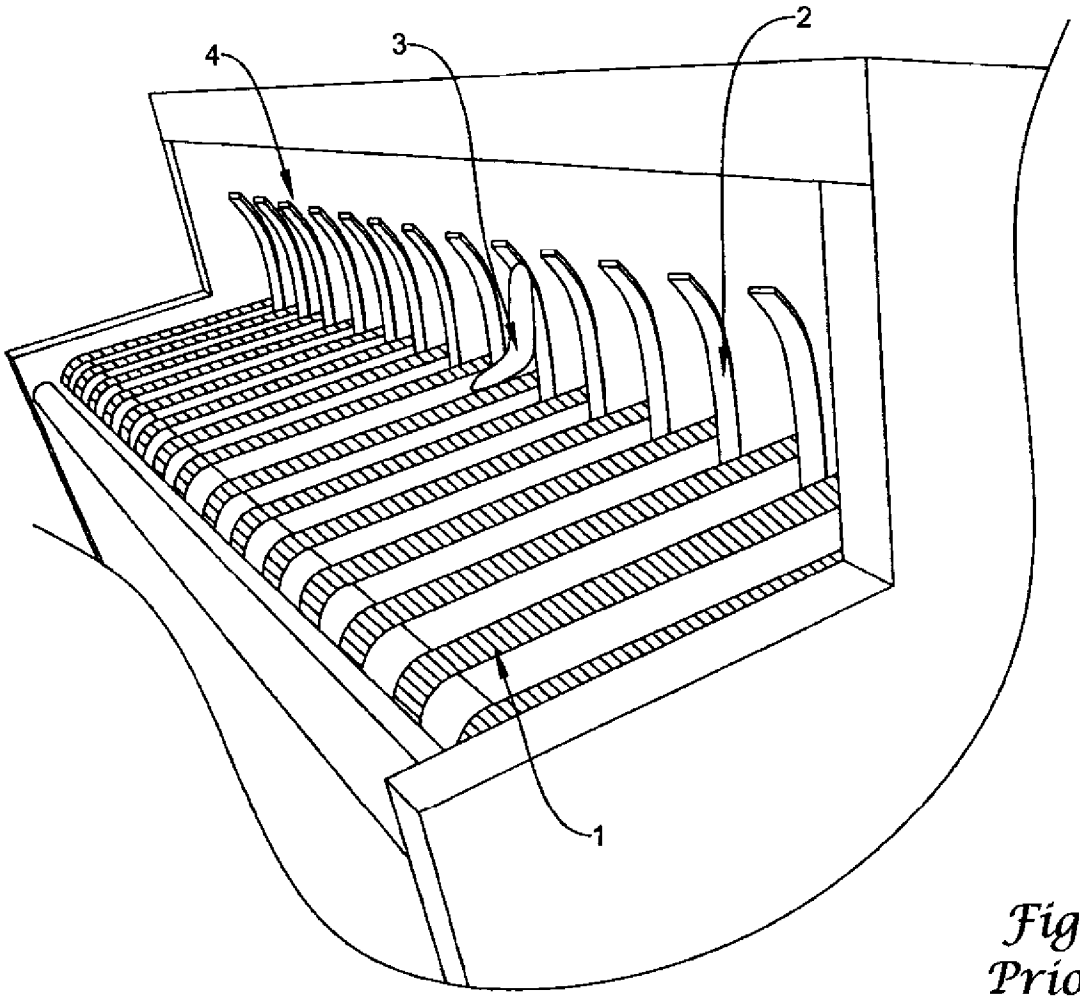
Figure 4 Prior Art
FIG. 4 illustrates a prior art bed roller machine.
Figure 5:
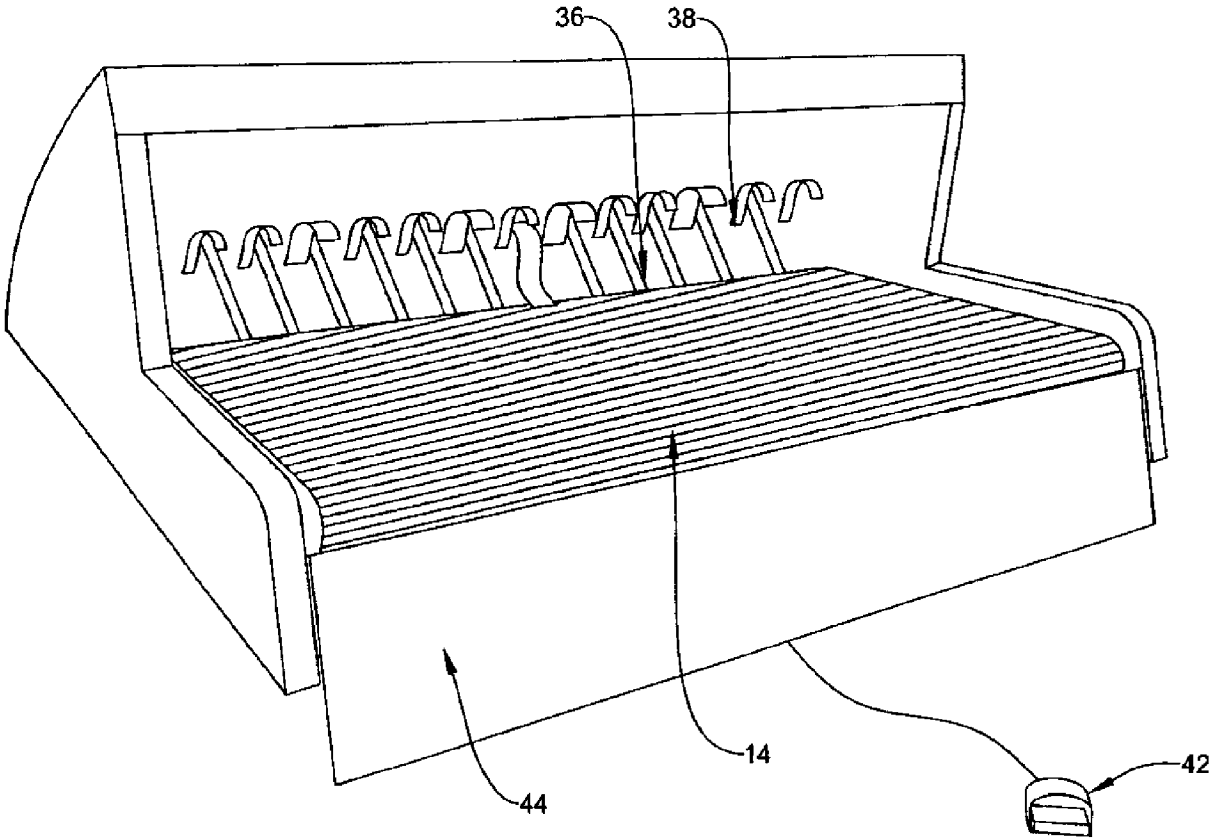
FIG. 5 illustrates an adjustable bed roller machine 10.

Main belt 14 is a wide single belt that feeds the rug to secondary belts 36 and then to tertiary belts 38, seen in FIG. 3. Main belt 14 is operated by rollers 22. Secondary belts 36 and tertiary belts 38 are interleaved, as shown in FIGS. 4 and 5. Secondary belts 36 are operated on rollers 24 and 26. Tertiary belts 38 share roller 26 with the secondary belts 36 and are operated on rollers 26 and 28. These belts provide the motive power that brings a rug into the machine to roll it up. When the belts are operating to bring the rug into the machine, they are moved, as viewed in FIG. 3, in a counter-clockwise direction. Belts 14, 36 and 38 are made from a textured, gripping material such as a woven rubber or other suitable material.

The adjustable belt roller machine 10 also includes a first set of fingers 32 and a second set of fingers 30. The first set of fingers 32 has a tighter curve, and the second set of fingers 30 has a wider curve, as can be best seen in FIG. 3. Each set of fingers may be independently pivoted down or up. The first set of fingers 32 may be attached to a first rod, which can pivot to operate the first set of fingers, and the second set of fingers may be attached to a second rod, which can pivot to operate the second set of fingers. An elbow 34 is centrally located, with approximately half of each set of fingers on each side of elbow 34. Elbow 34 includes a central concave portion that is positioned where belts 36 and 38 meet and helps to guide the rug as the front edge of the rug changes direction between belts 36 and 38. Elbow 34 and fingers 30 and 32 are made to have a relatively smooth surface and made be made from metal, plastic or another suitable material that does not create undue friction or heat as the rug is moved past the elbow and fingers.

The adjustable belt roller machine 10 may also include a set of pushers 46, 48, which may be used to push a rolled rug out from the hood cavity at the end of the operation. The pushers, 46, 48 may be operated by a hydraulic or pneumatic cylinder 50. Preferably, when pushers 46, 48 are activated, a safety plate 44 may be raised to prevent the rolled rug from falling off the end of the main belt 14. The safety plate 44 may be actuated by a hydraulic cylinder or other suitable mechanism. In some embodiments, the safety plate retracts automatically after a pre-determined period of time. For example, the safety plate may retract after a 1, 2, 3, 4, 5, 6, 7, 8, 9 or 10 second period.

Figure 6:
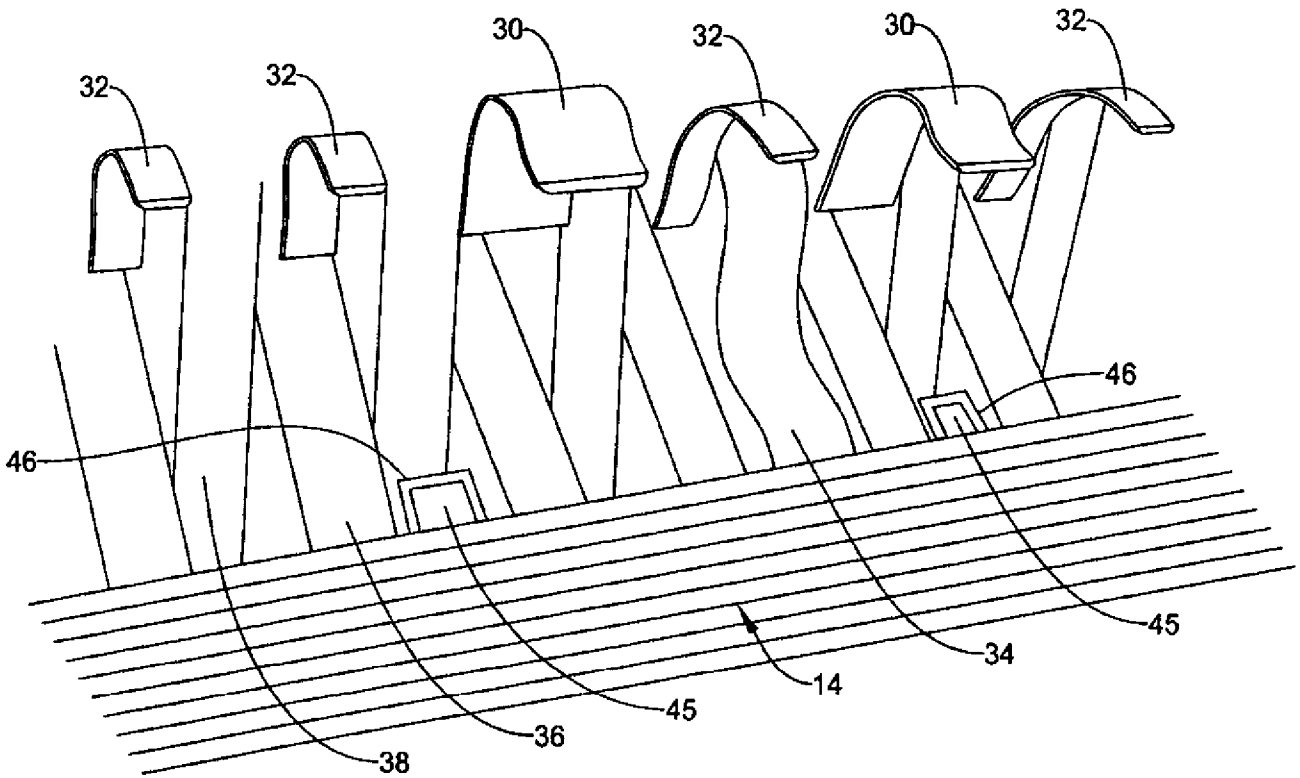
FIG. 6 illustrates a portion of an adjustable bed roller machine 10.

A sensor may be provided at the end of the main belt 14 to sense when the leading edge of a rug has moved past the end of the main belt. The sensor may be a photodetector, an opto-electronic sensor or other suitable sensor. In some embodiments, the sensor may include a light transmitter 47 under the hood 20, shown in FIG. 1 in phantom, and a receiver or reflector 45. Such a reflector may be disposed, for example, on pushers 46, as seen in FIGS. 2 and 6. When a rug passes over these reflectors on pushers 46, it interrupts the reflection of a beam of light from a light transmitter, which indicates that the leading edge of the rug has moved past the end of the main belt. This sensor may be incorporated into the control system as described below.

The hood 20 may include a light curtain or similar safety device. A light curtain may be provided at or towards the front of hood 20 and may sense any incursion into the top portion of the interior of the hood. For example, the light curtain may be configured to sense an incursion into the top 90%, 80%, 70%, or 60% of the hood. When an incursion is sensed, the controls automatically shut down the adjustable bed roller.

A foot pedal 42, seen in FIG. 5, is also provided as part of the controls, together with control panel 12. The foot pedal 42 may be located at a convenient spot under or near the front of the adjustable bed roller and may be used to start the rolling process, leaving the operator's hands free for the rug. In some embodiments, the foot pedal is depressed throughout the operation of the machine such that removing a foot from the foot pedal signals to the controls that the rolling operation is complete.

In use, a front edge of a rug may be positioned on the main roller 14, and the adjustable bed roller machine 10 may be started by depressing the foot pedal. This starts the rolling operation by starting to feed the rug into the machine. When the rug reaches the juncture between belts 36 and 38, an optical or other sensor (not shown) triggers the first set of fingers. The first set of fingers 32 rotates down and the rug moves up the tertiary belts 38, guided upwards by elbow 34, and is formed by the first set of fingers 32 into a tight initial roll. The leading edge of the rug is tightly curved around to rest on a following portion of the rug. Because the rug is being moved into the machine, the leading edge follows the following portion to form the coil of the roll. After a preset period of time, a number of coils have been formed by the first set of fingers 32, and the second set of fingers 30 rotates down and the first set of fingers rotates up. With each successive coil, the outer diameter of the coiled portion of the rug increases until the first set of fingers may not be suitable for coiling the rug into a roll. The second set of fingers 30 have a looser curve and are suitable for completing the rug rolling operation. When the operation is complete, the operator may remove his foot from the pedal, which activates pushers 46 and 48. Pushers 36 and 38 push the rolled rug onto main belt 14, where it can roll to the operator who then removes the rolled rug from the machine. A safety plate 44 may raise to prevent the rug from falling off the front end of the device.

The safety plate retracts after a preset period and the operator can remove the rolled rug from the machine. Once the pushers have pushed the rug out, they preferably automatically resets back into position ready for the next rug.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A bed roller machine for use in rolling a rug having a leading edge, comprising:

a main body having a hood having a mouth defining a cavity;

a main bed supporting a single main belt configured to move the leading edge of the rug from a front end of the main body into the cavity;

a plurality of belts configured to move the leading edge of the rug further into the cavity and up;

a first set of fingers, each finger of the first set having a surface having a first concave cylindrical curvature, wherein the surfaces of the first set are aligned, and wherein the first set of fingers is movable as a set; and a second set of fingers, each finger of the second set having a surface having a second concave cylindrical curvature wider than that of the first surface, wherein the surfaces of the second set are aligned, and wherein the second set of fingers is movable as a set, wherein the fingers of the first and second set of fingers are interleaved and positioned in the cavity proximate the end of the plurality of belts;

wherein the main belt extends across the width of the first set of fingers;

wherein during operation, each belt rotates in a direction of rotation.

2. The bed roller machine of claim 1, wherein the main belt has an upper surface that has an angle in the direction of rotation and wherein the upper surface of the main belt defines a plane.

3. The bed roller machine of claim 2, wherein the plurality of belts comprises:

a set of secondary belts, wherein each of the belts of the set of secondary belts has an upper surface and wherein the upper surfaces of each of the secondary belts are substantially in the same plane; and a set of tertiary belts, wherein each of the belts of the set of tertiary belts has an upper surface and wherein the upper surfaces of each of the tertiary belts are substantially in the same plane;

wherein the belts of the set of secondary belts and the set of tertiary belts are interleaved;

wherein the set of secondary belts are positioned between the main belt and the set of tertiary belts;

wherein the upper surfaces of the set of secondary belts has an angle in the direction of rotation that is more vertical than the angle of the upper surface of the main belt;

wherein the upper surfaces of the set of tertiary belts has an angle in the direction of rotation that is more vertical than the angle of the upper surfaces of the set of secondary belts.

4. The bed roller machine of claim 3, wherein the fingers of the first and second sets of fingers are interleaved with the belts of the tertiary set of belts.

5. The bed roller machine of claim 3, wherein the main belt has a first end and a second end;

wherein the direction of rotation is between the first end and the second end such that upper surface of the main belt moves towards the second end;

wherein the second end is disposed within the cavity of the hood; and further comprising a sensor to detect when the leading edge of a rug leaves the second end of the main belt.

6. The bed roller machine of claim 5, further comprising:

an elbow positioned at the middle of the second end of the main belt between belts of the set of second belts;

wherein the elbow has a curved concave surface facing toward the mouth for directing the leading edge of the rug upwards to the set of tertiary belts.

7. The bed roller machine of claim 6, wherein the actuation member is a hydraulic cylinder.

8. A method of using the bed roller machine of claim 5, comprising the steps of:

providing a rectangular rug having a leading edge;

providing the bed roller machine of claim 5;

placing the leading edge of the rug on the main belt parallel to the first end of the belt;

activating the bed roller machine, where the bed roller machine, when activated, performs the following steps in order:

a) activates the belts, the main belt moving such that the upper surface moves from the first end to the second end to provide rotation in the direction of rotation, the sets of secondary and tertiary belts also rotating in the direction of rotation, b) draws the leading edge of the rug into the cavity;

c) activates the sensor when the leading edge of the rug extends over the second end of the main belt;

d) when the sensor is activated, rotate the first set of fingers into a position where the surfaces of the first set of fingers will come into contact with the rug;

e) begin to roll the rug;

f) after a pre-determined period of time after step c, rotate the second set of fingers into a position where the surfaces of the second set of fingers will come into contact with the rug and rotate the first set of fingers out of the way; and g) finish rolling the rug;

9. The method of claim 8, comprising the further steps of:

wherein the bed roller machine further comprises a pusher that is retracted while the rug is being rolled and is extendable to push a rolled rug from the set of secondary belts to the main belt; and subsequent to step g, deactivating the bed roller machine where deactivation triggers the pusher to push the rolled rug onto the main belt.

10. The method of claim 8, comprising the further steps of:

wherein the main body of the bed roller machine further comprises a safety plate having an upper edge positioned proximate the first end of the main belt, the safety plate moveable between a first portion when the upper edge is below the plane and a second position where the safety plate is positioned above the plane, the safety plate being configured such that in the first position a rolled rug may roll off the first end of the main belt and that in the second position a rolled rug is prevented from rolling off the first end of the main belt; and subsequent to step g, moving the safety plate from the first position to the second position.

11. The method of claim 10, wherein the step of moving the safety plate from the first position to the second position is triggered by the deactivation of the bed roller machine.

12. The method of claim 11, comprising the further steps of:

automatically moving the safety plate from the second position back to the first position a predetermined period of time after the deactivation of the bed roller machine.

13. The bed roller machine of claim 3, further comprising:

a pusher that is retracted while the rug is being rolled and is extendable to push a rolled rug from the set of secondary belts to the main belt.

14. The bed roller machine of claim 13, further comprising:

a set of pushers that are retracted while the rug is being rolled and are extendable to push a rolled rug from the set of secondary belts to the main belt.

15. The bed roller machine of claim 3, wherein the main body further comprises a safety plate having an upper edge positioned proximate the first end of the main belt, the safety plate moveable between a first portion when the upper edge is below the plane and a second position where the safety plate is positioned above the plane, the safety plate being configured such that in the first position a rolled rug may roll off the first end of the main belt and that in the second position a rolled rug is prevented from rolling off the first end of the main belt.

16. The bed roller machine of claim 1, further comprising:

a frame wherein the main body is connected to the frame by a pivot joint; and an actuation member such that the front end of the main body is movable up and down relative to the frame by operation of the actuation member.

* * * * *